US005577834A

United States Patent [19]

Mazies et al.

[11] Patent Number: 5,577,834

[45] Date of Patent: Nov. 26, 1996

[54] LIGHT EMITTING DEVICE

[75] Inventors: Timothy J. Mazies, Oak Forest; Arthur Cox, Park Ridge, both of Ill.

[73] Assignee: Federal Signal Corporation, University Park, Ill.

[21] Appl. No.: 247,547

[22] Filed: May 23, 1994

[51] Int. Cl.[6] ..... F21V 7/00

[52] U.S. Cl. ..... 362/302; 362/298; 362/346

[58] Field of Search ..... 340/331, 332, 340/815.69; 362/147, 297, 298, 301, 302, 346, 307, 310

[56] References Cited

U.S. PATENT DOCUMENTS

| | | | |
|---|---|---|---|
| 33,447 | 10/1861 | Odel et al. . | |
| 344,532 | 6/1886 | Jones . | |
| 1,153,443 | 9/1915 | Pole . | |
| 2,717,307 | 9/1955 | Bjontegard | 362/346 |
| 4,112,483 | 9/1978 | Small, Jr. et al. | 362/298 |
| 4,174,533 | 11/1979 | Barthes et al. | 362/346 |
| 4,229,782 | 10/1980 | Ruud et al. | 362/297 |
| 4,337,507 | 6/1982 | Lasker | 362/302 X |
| 4,536,828 | 8/1985 | Mori | 362/32 |
| 4,649,376 | 3/1987 | Frank | 340/691 |
| 4,701,832 | 10/1987 | Lasker | 362/281 |
| 4,731,714 | 3/1988 | Kelly et al. | 362/310 |
| 4,733,338 | 3/1988 | Feher et al. | 362/310 |
| 4,947,305 | 8/1990 | Gunter, Jr. | 362/297 |
| 5,062,030 | 10/1991 | Figueroa | 362/346 |
| 5,251,115 | 10/1993 | Hillman et al. | 362/346 X |
| 5,390,095 | 2/1995 | Lemons et al. | 362/297 X |

OTHER PUBLICATIONS

"Wheelock, Inc. Product Catalog"; Long Branch, NJ., May 1993.

"Edwards System Technology Product Catalog"; Sarasota, FL., 1992.

*Primary Examiner*—Stephen F. Husar

*Attorney, Agent, or Firm*—Leydig, Voit & Mayer

[57] ABSTRACT

A light emitting device includes a reflector assembly combined with a chassis. A light source is coupled to the reflector assembly. A reflective surface is formed on the reflector assembly to reflect light generated by the light source. A transparent cover is mated to the chassis enclosing the reflector assembly and the light source.

29 Claims, 12 Drawing Sheets

LIGHT EMITTING DEVICE

FIELD OF THE INVENTION

The invention relates to a light emitting device, and, more particularly to a signaling device for the hearing impaired.

BACKGROUND OF THE INVENTION since passage of the Americans with Disabilities Act (ADA), increasing amounts of attention have been directed to improving safety conditions for the disabled in the home and in the workplace. One of the areas of great concern is the production of fire and smoke detection devices for the hearing impaired. It is well recognized that traditional audible fire and smoke detection devices are often insufficient to warn persons having hearing disabilities of the presence of fire hazards. To counteract this problem, various different alarm systems have been employed including flashing light, vibration and air movement systems.

U.S. Pat. No. 4,649,376 discloses a fire alarm system consisting of both visual and audible components. A smoke detector unit is mounted on the ceiling of a hallway. The smoke detector unit generates an audible alarm to alert occupants that the level of smoke in the hallway is excessive. Lamp units are provided in the hallway to provide visual directional signals for directing occupants to an exit. The lamp units are positioned in a lower region of the hallway such that they are in a region of minimum smoke. To facilitate escape in case of fire, it is recommended that occupants drop to the floor and follow the lamp units and crawl to the nearest exit.

Although the forgoing fire alarm system consists of audible and visual components, the visual components are used only as directional signals to direct occupants to exits after the occupants have been alerted of the presence of a fire hazard. The occupants are actually alerted of the fire hazard by the audible alarm. A severe risk of injury is presented if the audible alarm is not effective to alert the occupants. Thus, it is desirable to provide a visual alarm device to alert occupants of the presence of a fire hazard.

The Underwriters Laboratories, Inc. (UL) published standards for luminous intensity of light based alarms in a publication entitled, "Standard for Signaling devices for the Hearing Impaired" UL 1971, First Edition, Jun. 30, 1992 which is herein incorporated by reference. The UL standard tracks luminous intensity along vertical and horizontal arcs about a light emitting device as depicted in FIG. 1. When designing a device to generate an intensity profile that matches a desired standard, several factors must be considered such as the intensity of the light source and the position of the light source. Often, fire alarms operate on back-up battery power because primary power is unavailable. Thus, it is desirable to keep power consumption to a minimum. A most efficient system will consume only enough energy to create an intensity profile that substantially follows the UL standard.

SUMMARY OF THE INVENTION

An object of the invention is to provide a light emitting device that can effectively alert hearing impaired persons, both conscious and unconscious, of the presence of a fire hazard while consuming a minimum amount of energy.

Another object of the invention is to provide a light emitting device that generates an intensity profile that substantially matches the UL 1971 Standard intensity profile while consuming a minimum amount of energy.

A further object of the invention is to provide a light emitting device that generates an intensity profile that substantially matches a predetermined standard intensity profile while consuming a minimum amount of energy.

These and other objects may be realized by a light emitting device that generates a light beam and efficiently distributes its candela power through an arc centered at the device. The device includes a chassis with a reflector assembly. The reflector assembly is covered with a reflective surface. A light source is coupled to the reflector assembly and a transparent cover is mated to the reflector assembly covering the light source and the reflective surface. The reflective surface forms one or more reflections of the light source visible at different angles of the arc. A standoff provides a spatial relationship between the reflector assembly and the lamp that distributes a sum of the reflections and the light source visible at any angle of the arc in a manner approximately proportional to a desired distribution of candela levels of the beam along the arc.

In accordance with an aspect of the invention, the reflector assembly includes a pair of curved sections aligned such that a longitudinal axis of one curved section is parallel to a longitudinal axis of the other curved section. The particular shape of the curved sections may be selected according to the desired distribution of candela levels. For example, the curved sections may each take the shape of a cylinder, including a parabolic cylinder and a circular cylinder, or a cone. Other shapes are also possible.

DETAILED DESCRIPTION OF PREFERRED EMBODIMENTS

The subject of the invention is directed to a light emitting device. Generally, in accordance with the invention, a chassis is provided for mounting the light-emitting device onto a surface such as a gang box, a horn, speaker or a plate. A transparent cover is mated with the chassis. A reflector assembly and a light source are positioned inside the mated chassis and transparent cover for directing light having a predetermined intensity profile through the transparent cover.

Figure 2:
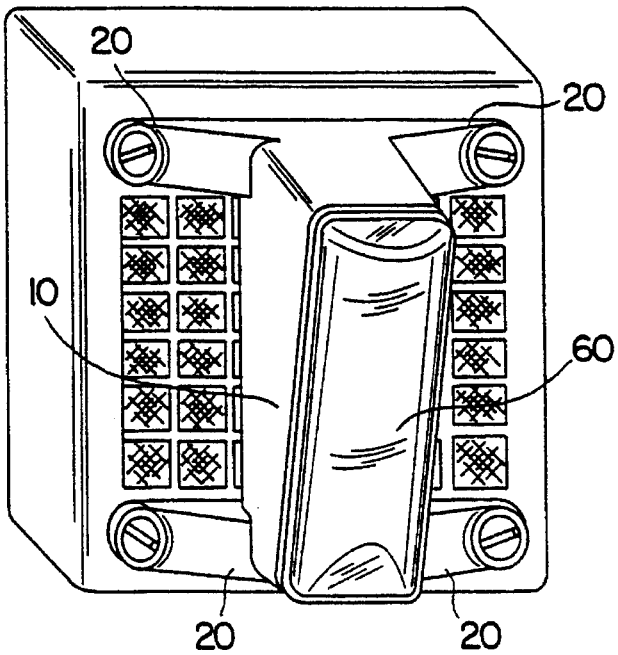
FIG. 2 is a perspective view of the light emitting device according to an embodiment of the invention.
Figure 4:
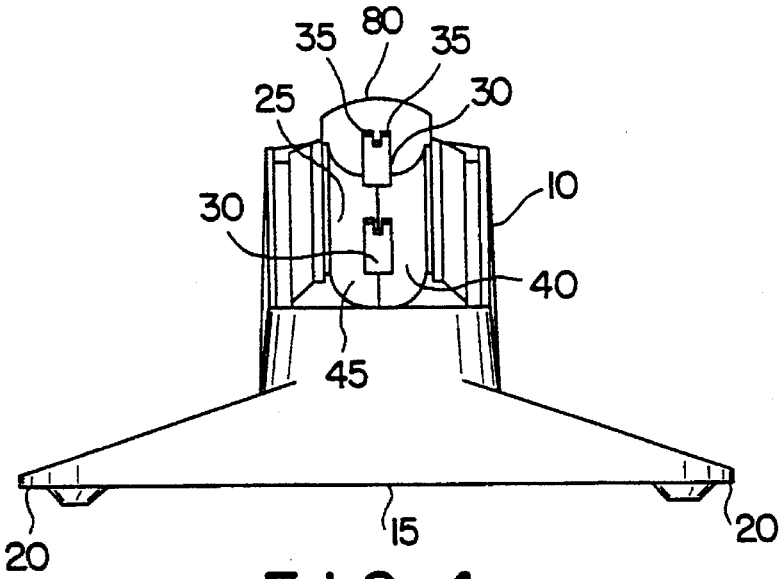
FIG. 4 is a front view of the light emitting device according to an embodiment of the invention.

In accordance with a first embodiment of the invention, a chassis 10 is provided with a base 15 having connectors to facilitate connection to a structure. The connectors may be, but are not limited to, legs 20 as shown in FIG. 2. The chassis 10 may include a longitudinally extending reflector assembly 25 having an ogive-shaped cross section "Ogive", as used herein, is defined as a curve comprising two parts, where the tangent lines of each part form an angle with each other that is different from zero at the meeting point of the two parts. Preferably, the assembly defines a channel formed in a surface of the chassis 10 as depicted in FIG. 4. However, it is contemplated that the reflector assembly 25 may comprise a separate unit.

Attachment members may be projected from the reflector assembly 25 to secure the light source 50 to the chassis 10. The attachment members may include stand-offs 30 having fingers 35 as shown in FIG. 4.

In accordance with an aspect of the invention, the reflector assembly 25 may include first and second intersecting sections 40 and 45. Preferably, the first and second sections are aligned such that a longitudinal axis of the first section is parallel to a longitudinal axis of the second section. The sections may have various geometric configurations depending upon the desired characteristics of the intensity profile. Each section may be, for example, a cylinder, a cone, or any cylindrical or conical surface as defined in *CRC Standard Mathematical Tables* 1984 and any combination thereof.

To enhance light emission, a reflective surface 27 is connected to the reflector assembly 25. The reflective surface 27 may be formed from any high-reflectivity material such as aluminum, silver or chrome. Preferably, the reflective surface 27 is connected to the reflector assembly 25 by a metalization process such as vacuumetalization or electrodeposition. More preferably, the reflective surface 27 may be connected to the reflector assembly 25 by vacuumetalizing a high reflectivity material over the reflector assembly 25. Thus, the reflective surface 27 adopts the shape of the reflector assembly 25. During vacuumetalization, the attachment members are masked so that they remain uncovered by the high reflectivity material.

Alternatively, the reflective surface may be premolded and subsequently connected to the reflector assembly 25 by any conventional attachment process. For example, the reflective surface 27 may be press fit onto the reflector assembly 25.

Figure 2A:
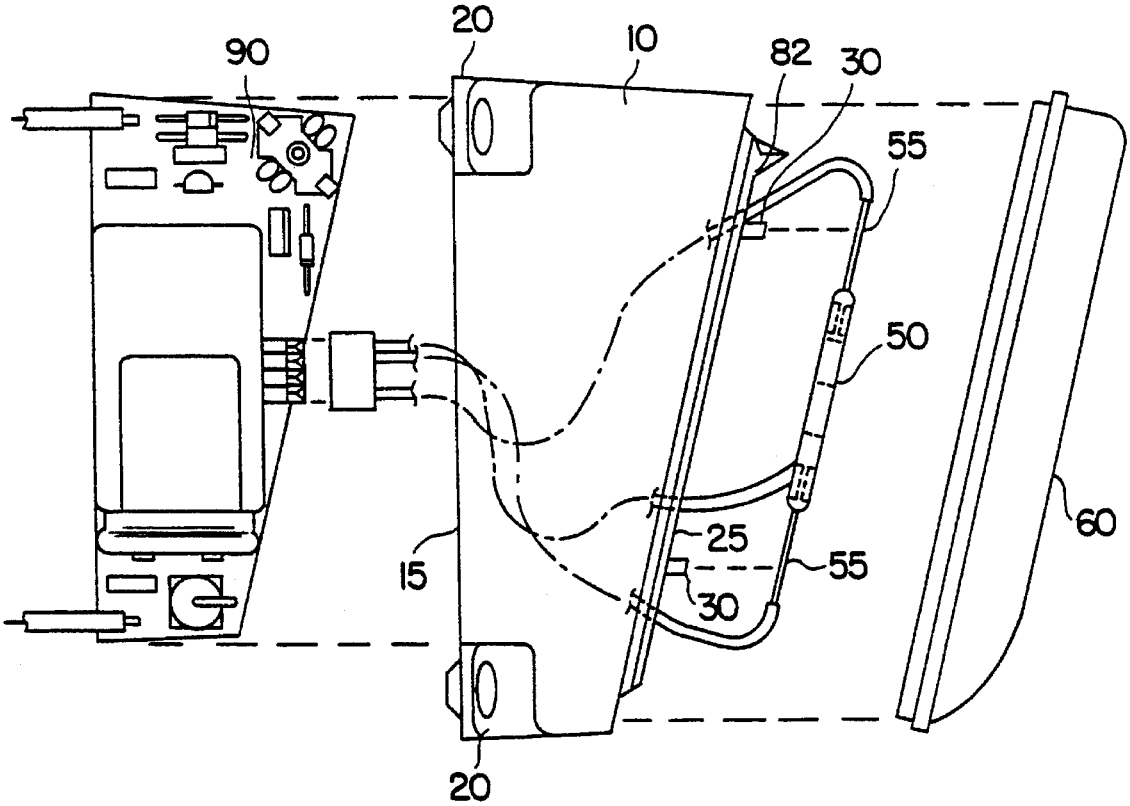
FIG. 2A is an exploded view of the light emitting device according to an embodiment of the invention.
Figure 3:
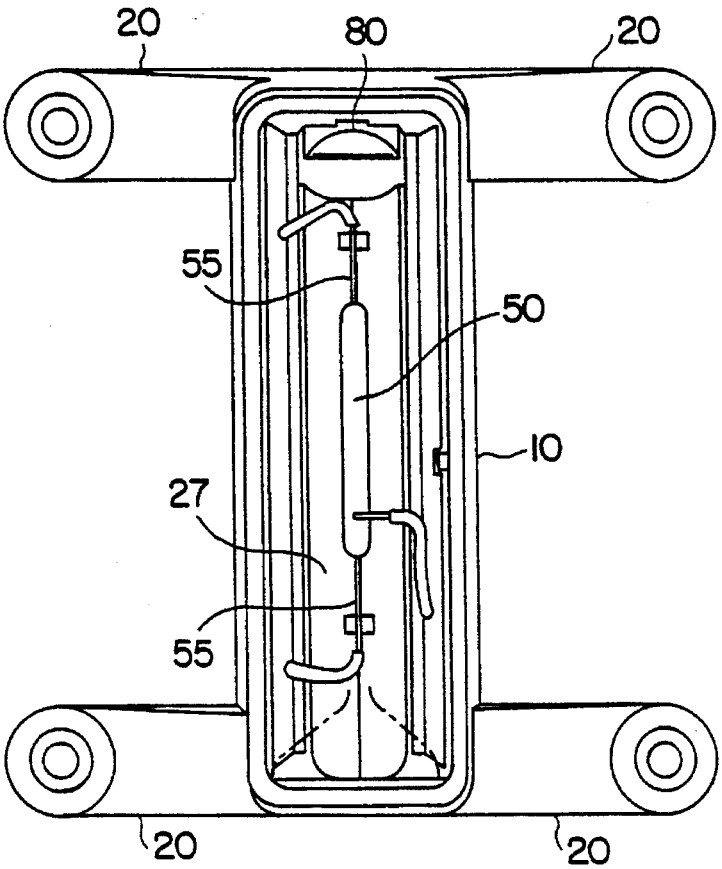
FIG. 3 is a top view of the light emitting device according to an embodiment of the invention.

A light source 50 may be coupled to the chassis 10 by the attachment members. For example, as illustrated in FIG. 2A and 3, the light source 50 includes leads 55 that fit between the fingers of the attachment members. The attachment members may be heat-staked to melt the fingers forming a secure bond with the leads 55 to thereby attach the light source 50 to the reflector assembly 25.

Preferably, the light source 50 comprises a xenon flash tube having a strobe cycle ranging from about 30 flashes per minute to about 60 flashes per minute and having a life expectancy of at least 72 hours. A suitable flash tube is available from EG&G Optoelectronics, Montgomeryville, Pa. The size and shape of the light source 50 may be selected according to the desired intensity profile and the desired maximum intensity value.

A transparent cover 60 is fit over the light source 50 and reflector to protect the light source 50 and reflector from contamination. The transparent cover 60 may include materials such as plastic or glass. In the illustrated embodiments, the transparent cover 60 is non-imaging. However, if desired, the transparent cover 60 may be a lens having sufficient optical power to affect the intensity profile.

Figure 1:
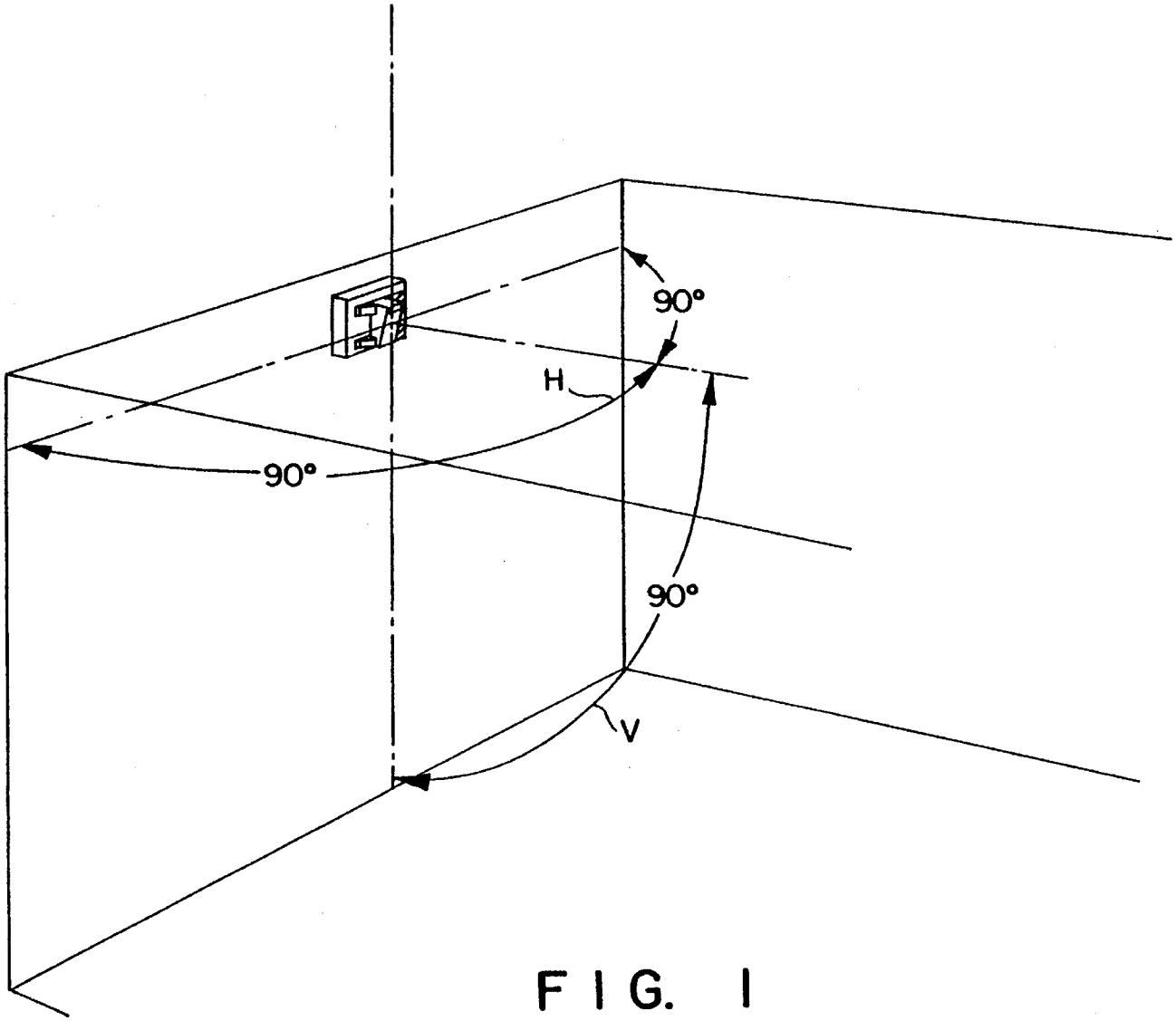
FIG. 1 is a plan view of the light emitting device according to an embodiment of the invention installed along a wall in a room.

The UL rates signaling devices for the hearing impaired according to light output along a horizontal arc and light output along a vertical arc. FIG. 1 depicts a light emitting device as described above having a horizontal arc H and a vertical arc V. The horizontal arc traverses an angle from −90° to 90° and the vertical arc traverses an angle from 0° to 90°. When the light emitting device of the present invention is used as a signaling device for the hearing impaired such as a fire alarm, it is likely that the light emitting device will be required to operate under back-up battery power. Thus, it is important that the light emitting device consume as little energy as possible while generating an intensity profile that substantially matches the UL 1971 Standard intensity profile and avoiding premature depletion of the back-up battery power source.

Figure 5:
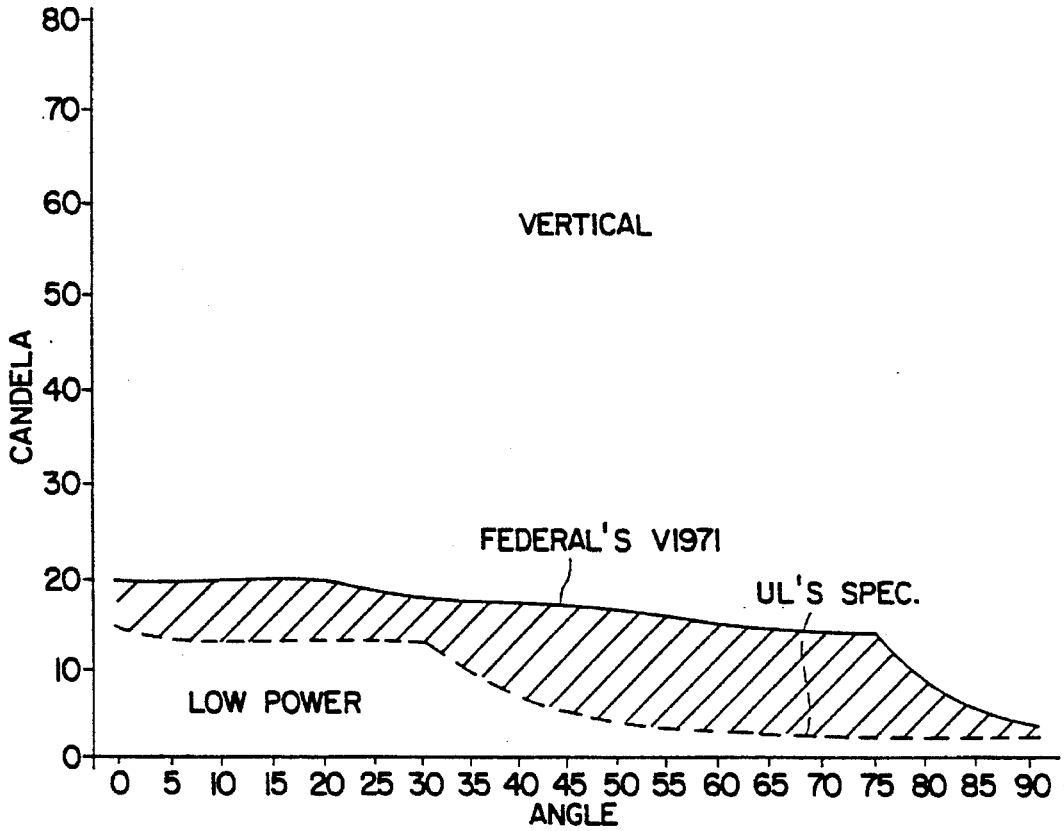
FIG. 5 is a graph illustrating the UL 1971 Standard intensity distribution in the vertical direction and the intensity distribution of the light emitting device according to the present invention in the vertical direction.
Figure 6:
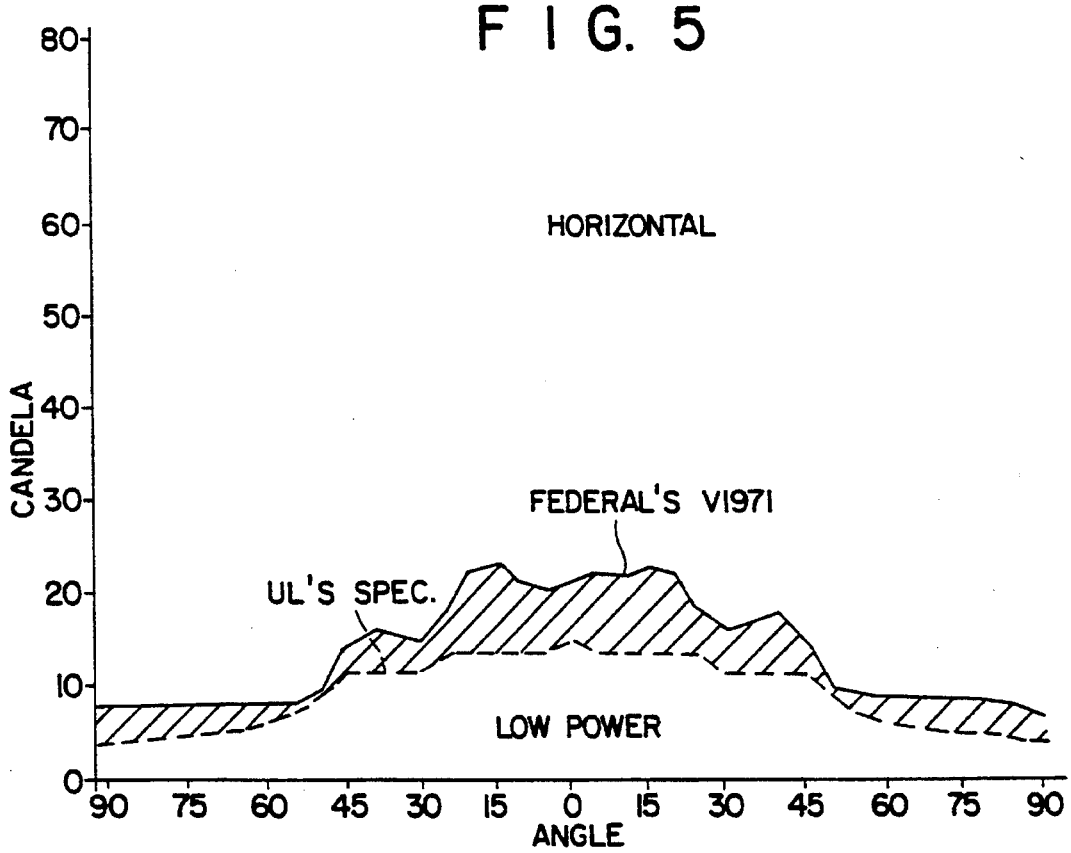
FIG. 6 is a graph illustrating the UL 1971 Standard intensity distribution in the horizontal direction and the intensity distribution of the light emitting device according to the present invention in the horizontal direction.
Figure 7:
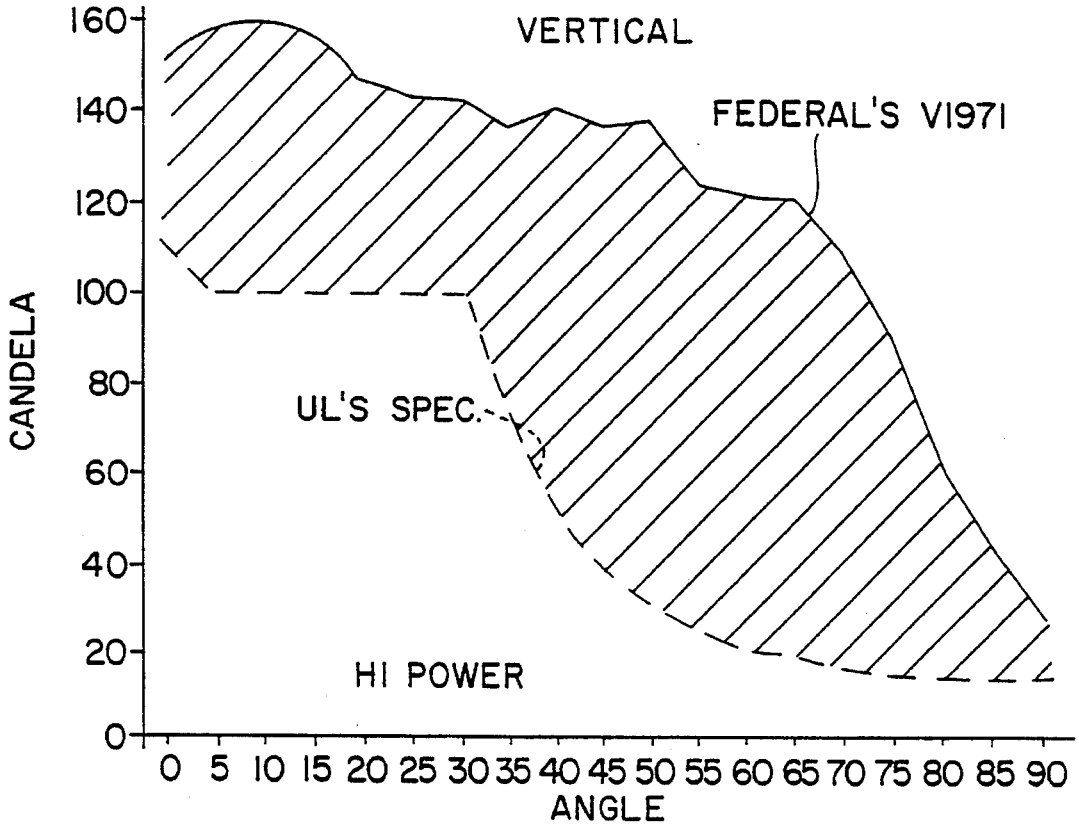
FIG. 7 is a graph illustrating the UL 1971 Standard intensity distribution in the vertical direction and the intensity distribution of the light emitting device according to the present invention in the vertical direction.
Figure 8:
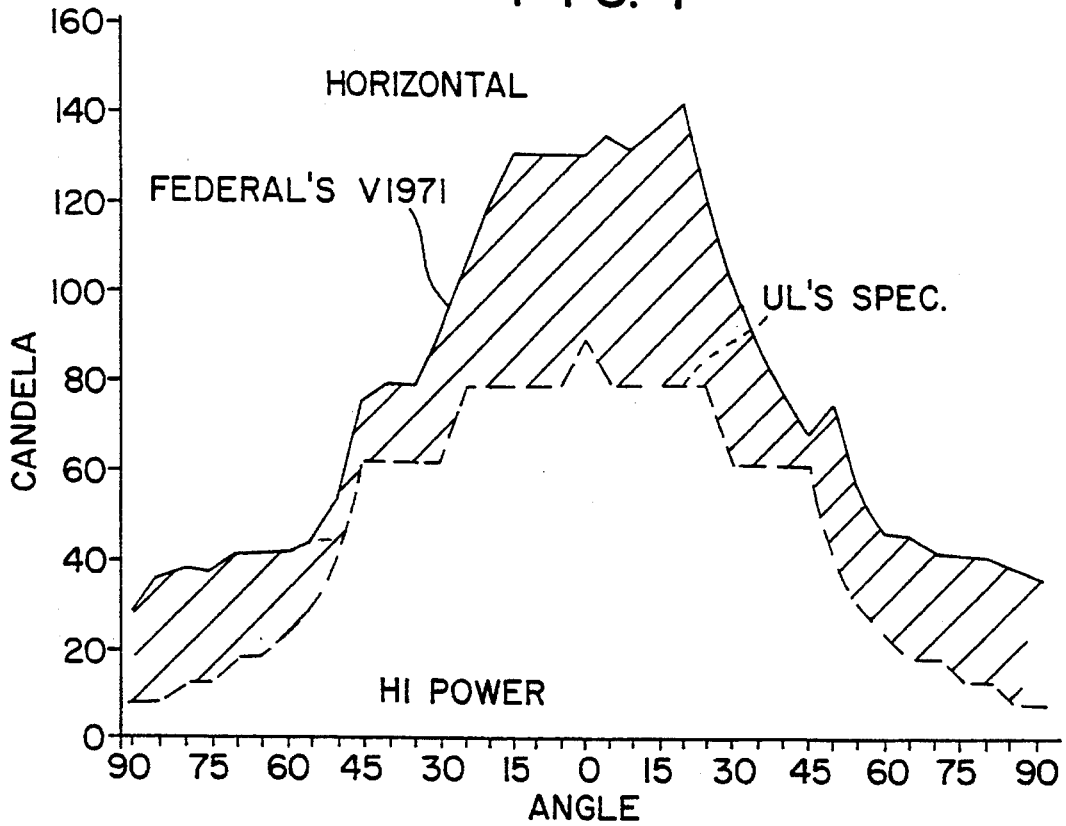
FIG. 8 is a graph illustrating the UL 1971 Standard intensity distribution in the horizontal direction and the intensity distribution of the light emitting device according to the present invention in the horizontal direction.

FIGS. 5–8 illustrate the UL 1971 Standard intensity profile in luminous intensity units (candelas). The dashed lines in FIGS. 5 and 6 represent the UL standard vertical and horizontal intensity profiles, respectively, for a low power light emitting device. FIGS. 7 and 8 represent the UL 1971 Standard vertical and horizontal intensity profiles, respectively, for a high power light emitting device. The cross-hatching in FIGS. 5–8 represents the area between the curves representing the intensity profile generated by a light emitting device according to the present invention and the UL 1971 Standard intensity profile. This area is defined as the intensity profile deviation.

Figure 9:
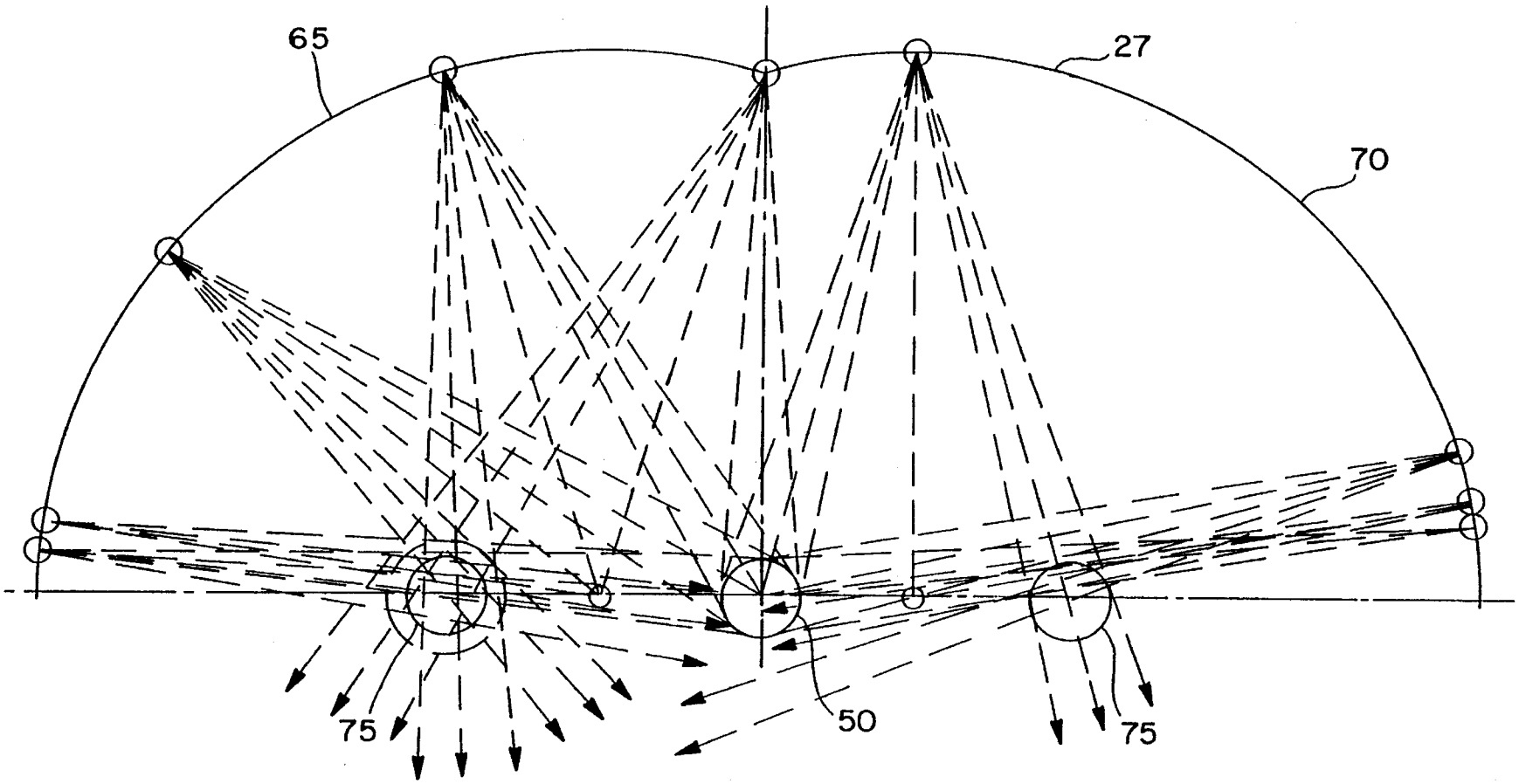
FIG. 9 is a ray diagram illustrating the path of light reflected in the light emitting device according to an embodiment of the invention.

In accordance with the invention, the first and second sections 65 and 70 may be cylindrical surfaces. As illustrated in FIG. 9, each of the first and second sections 65 and 70 has a center of curvature 67 and 73, respectively. Preferably, the first reflective section 65 has a radius that is identical to the radius of the second reflective section 70. To provide an intensity profile that substantially matches the UL 1971 Standard intensity profile, the light source is positioned directly above the intersection of the first and second reflective sections midway between the centers of curvature 67 and 73 of the first and second reflective sections 65 and 70. The term "substantially matches" as used herein means that the intensity profile has an intensity profile deviation that is no greater than the intensity profile deviation set forth in FIGS. 5 and 6 (for a low power system) and FIGS. 7 and 8 (for a high power system).

Figure 10:
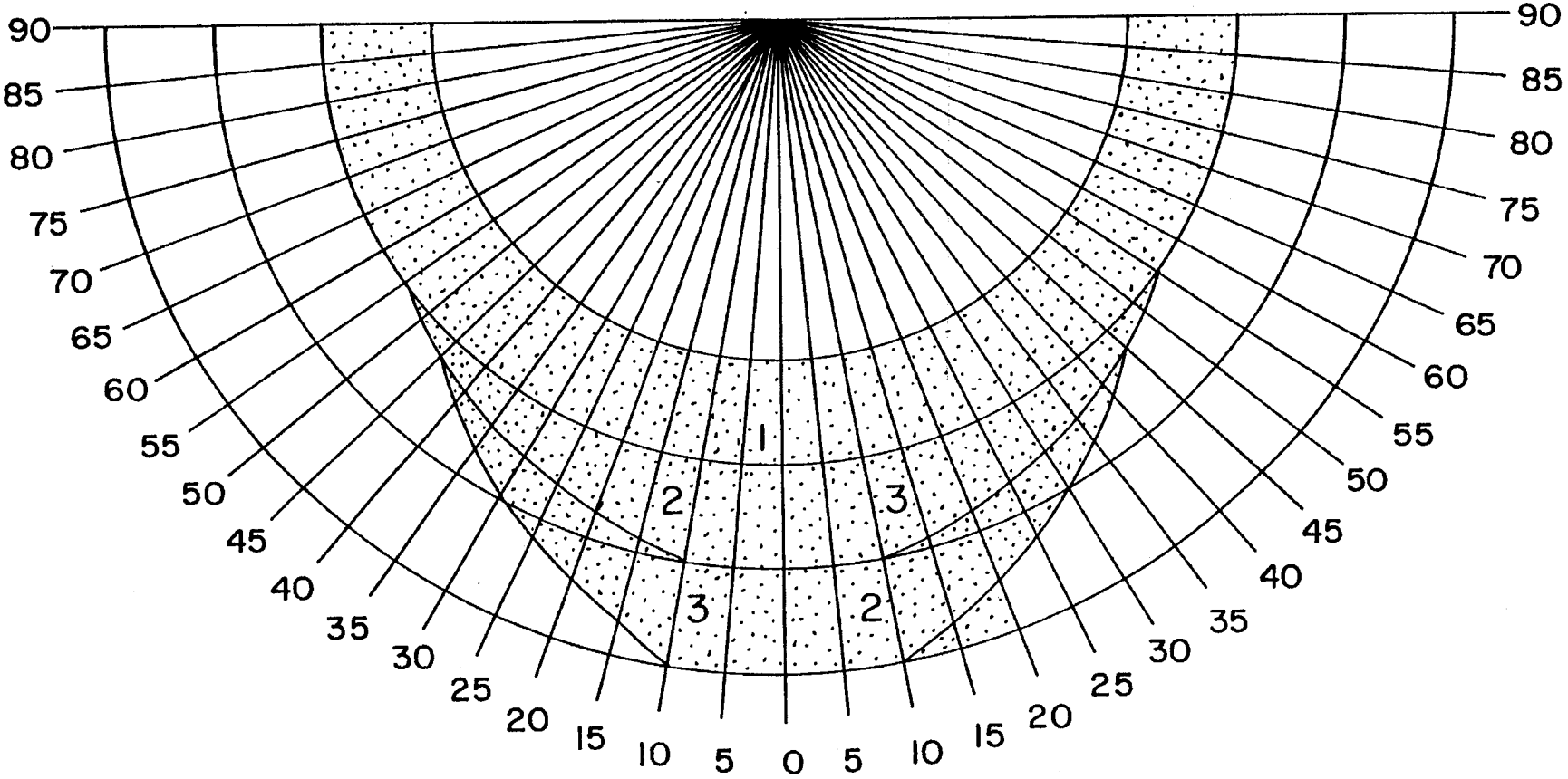
FIG. 10 is a graph of the intensity profile of the present invention in terms of the number of images that are visible from a point along a horizontal arc.

The attachment members space the light source 50 from the reflector assembly 25 so that each reflective section 65 and 70 generates a reflection of the source. When the light source 50 is positioned as described, three sources are visible at 0° along the horizontal arc—the real source 50 and two reflective sources 75. FIG. 10 is a graph that illustrates the number of reflected sources visible at all points along the horizontal arc. The shaded regions represent the number of visible sources. Numeral 1 represents the real source, numeral 2 represents the source reflected from the first reflective section 65 and numeral 3 represents the source reflected from the second reflective section 70. As the horizontal arc is traversed, the number of visible sources decreases. The reflected sources disappear between the angles of 55° and 90° and −55° and −90°. Along the vertical arc, at 90°, the real source and two reflected sources are visible. As the vertical arc is traversed from 90° to 0°, the intensity of visible sources decreases according to the cosine function. Thus, the intensity profile of the light emitting device according to the present invention can be described in terms of the number of reflected sources visible at points along the vertical and horizontal arcs.

To avoid an excessive decrease in intensity, at high angles along the vertical arc, the channel and the reflector assembly 25 are inclined from the plane of the base 15 of the chassis 10. Through an empirical study, it was determined that a preferred angle of inclination lies between 10° and 15°. Most preferably, the angle of inclination is about 13° as best shown in FIGS. 2 and 2A.

Figure 11:
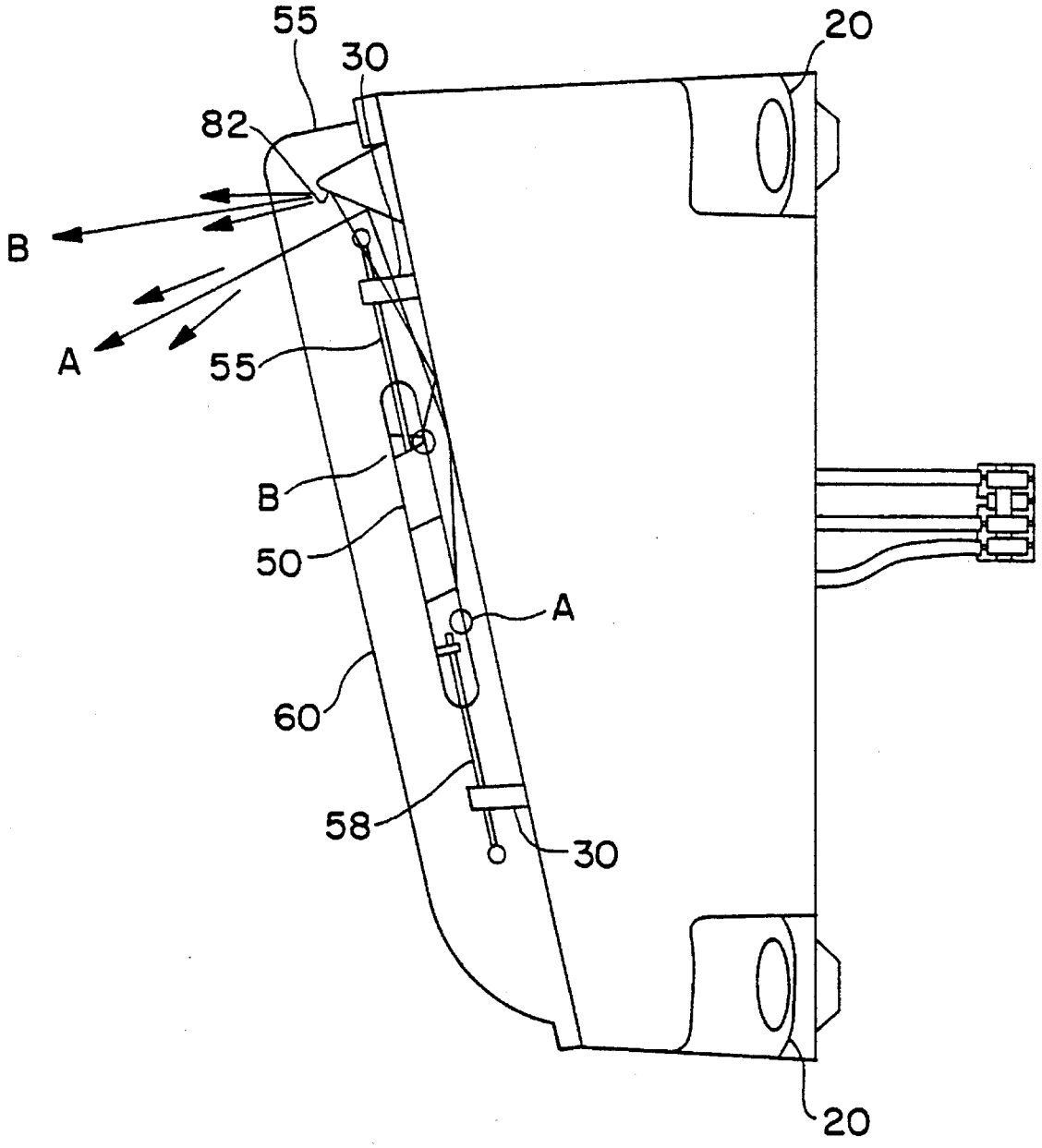
FIG. 11 is a ray diagram illustrating the path of light reflected from an abutment the light emitting device.

In keeping with the invention, to improve the intensity profile along the horizontal arc and to minimize light loss to unwanted areas when the light emitting device of the present invention is wall mounted as shown in FIG. 1, an abutment 80 may be disposed on one end of the channel of the chassis 10 as depicted in FIGS. 2A, 4 and 11. The abutment 80 is vacuumetalized during the previously described vacuumetalization procedure of the channel so that it includes a reflective surface 27. The abutment 80 is preferably positioned to redirect light reflected from the first and second surfaces of the reflector assembly 25 to "fill in" the intensity profile. That is, the abutment 80 may be positioned to add light intensity to points along the horizontal and vertical arcs that may be below the UL 1971 Standard intensity value. The abutment 80 also improves efficiency by redirecting light that would otherwise radiate at angles greater than 90° along the vertical arc into the 0° to 90° profile range.

As shown in FIGS. 2A and 11, the abutment 80 may be a plate 82 disposed at an obtuse angle with respect to a longitudinal axis of the reflector assembly 25. To help shape the intensity profile to match the UL 1971 Standard intensity profile, preferably, the plate 82 is disposed at an angle of between 90° and 130°. Most preferably, the plate 82 is disposed at an angle of about 128°. Of course, if it is desired to match the intensity profile to a standard different from the UL 1971 Standard, the angular position of the abutment 80 may be altered. However, in the light emitting device according to the invention, the plate 82 adds to the intensity profile along the horizontal arc by approximately 5% at an angle of up to plus or minus 25°. Also, the plate 82 adds to the intensity profile along the vertical arc between 0° and 45°.

Figure 18:
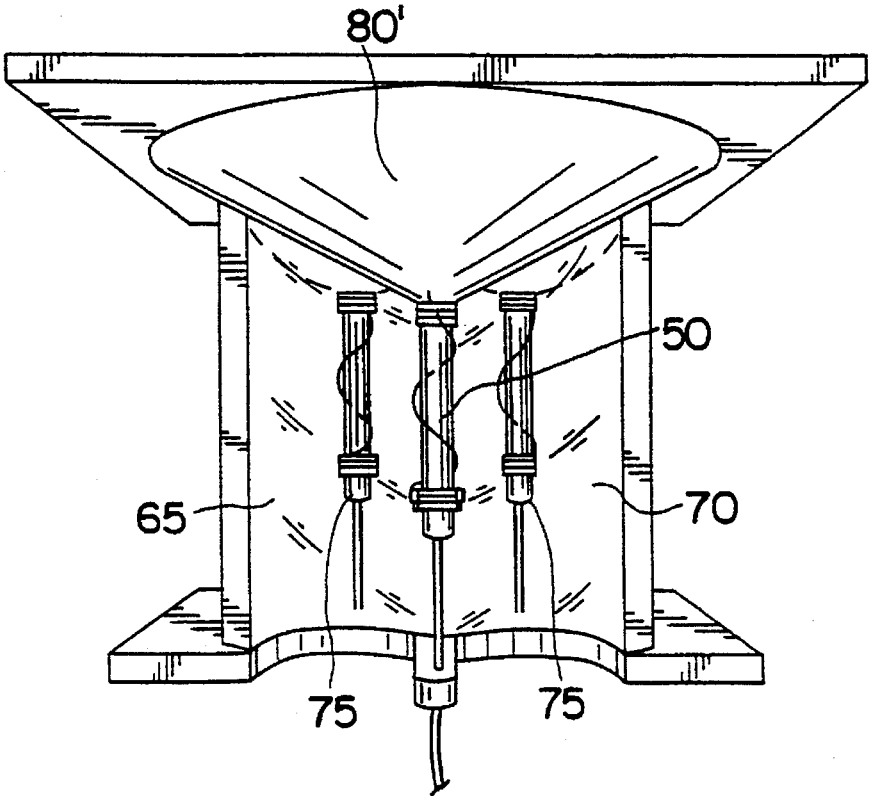
FIG. 18 is a top sectional view of a light emitting device according to an embodiment the invention.

In keeping with the invention, the abutment 80 may have a construction different from that described above. For example, an alternate embodiment of the invention is depicted in FIG. 18. There, like reference numerals to those set forth in FIG. 9 represent like elements. In the embodiment of FIG. 18, the abutment 80 is conical. Alternatively, the abutment 80 may be any other shape that will redirect light to the points along the horizontal and/or vertical arc where light is needed to augment the intensity profile. Ultimately, the shape of the abutment 80 may be chosen according to the desired intensity profile.

Figure 12:
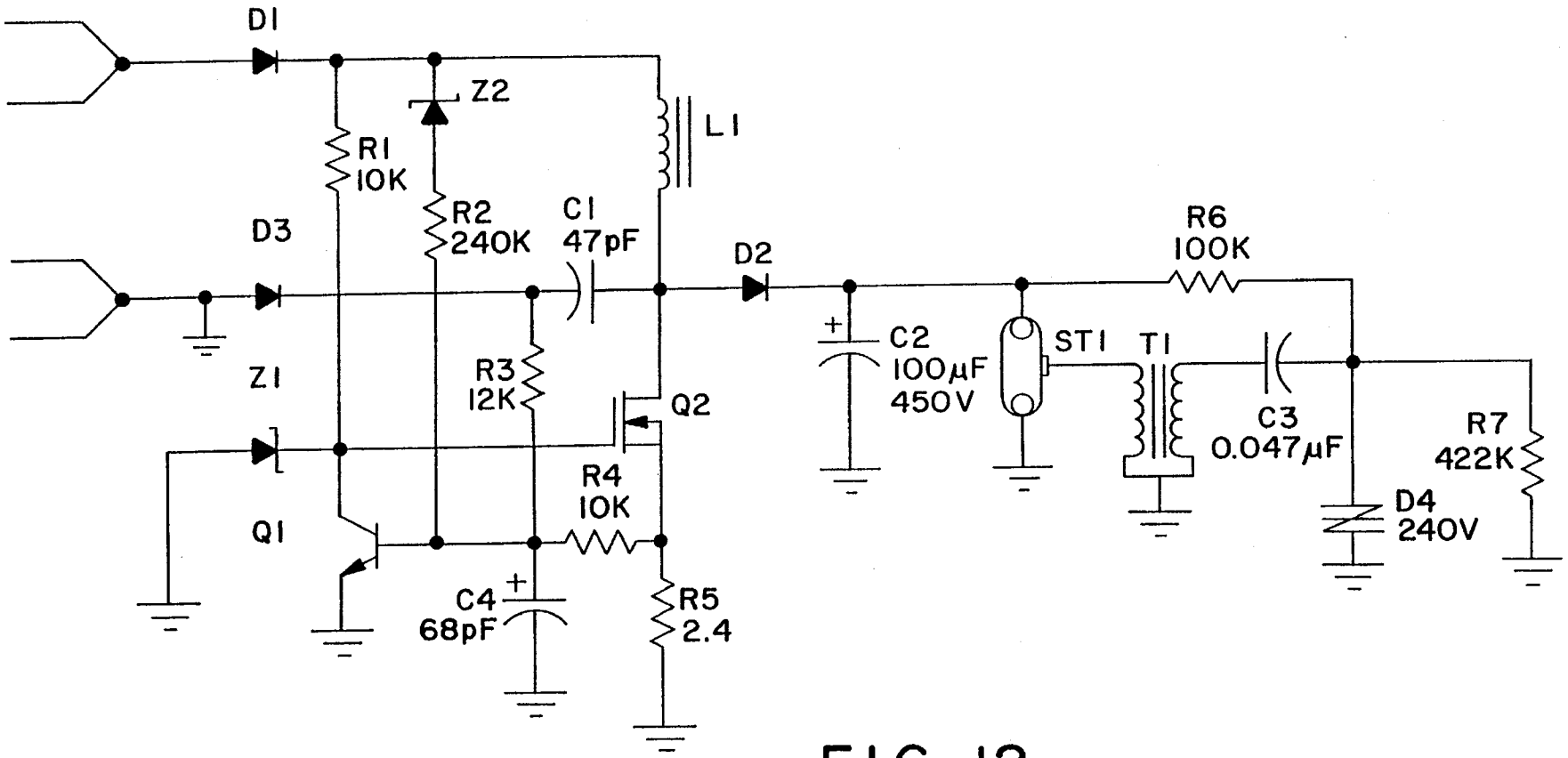
FIG. 12 is a schematic diagram of a driving circuit for the light emitting device.

FIG. 2A shows a driving circuit for the high power light source 50 implemented on a pc board 90. FIG. 12 is a detailed schematic diagram of the driving circuit. The driving circuit includes two main sections separated by a diode D2. The first section boosts the input voltage to a level which can flash the strobe tube. The second section flashes the tube which in turn resets the entire circuit. More particularly, the first section may be a conventional "boost regulator" which includes an inductor L1 that is turned on and off by a gate Q2 to transmit an ever increasing amount of high voltage energy to a capacitor C4. The gate Q2 turns on and off at a frequency of about 4 kHz. Each cycle produces a slightly higher voltage which is transferred to the capacitor C2 when the gate Q2 is off. The speed at which the voltage is transferred depends on the inductance of the inductor L1, the resistor R5 and the voltage level which is required for the second section of the driving circuit. The operation of gate Q2 is controlled by transistor Q1. The remaining elements in section 1 of the driving circuit are used to stabilize the performance of the circuit over the input voltage range.

Section 2 of the driving circuits flashes the strobe tube ST1 when the capacitor C2 has reached an appropriate value. Resistor R7 is used to control the charging level of capacitor C2. Lower values of resistor R7 produce higher voltages on capacitor C2, which, in turn, produce greater candela output from the strobe tube. When the resistor R7 is of infinite resistance (the resistor R7 is removed from the circuit) the lowest allowable voltage is generated across capacitor C2. When the voltage across the capacitor C2 reaches the selected value, sidac D4 will cause capacitor C3 to discharge through transformer T1 to fire the strobe tube ST1. The strobe tube ST1 flashes, discharging all of the capacitor C2's energy and effectively resetting the driving circuit and readying the driving circuit for the next flash. The light emitting device of the present invention is not limited to the described driving circuit, rather the described driving circuit is merely exemplary of a suitable driving circuit for the light source 50.

One of the primary objectives of the light emitting device according to the invention is to generate an intensity profile that matches the UL 1971 Standard intensity profile as closely as possible. If the generated intensity profile is substantially below the UL 1971 Standard intensity profile, then there is a considerable likelihood that the emitting device will be ineffective in alerting occupants of the presence of a fire hazard. However, if the generated intensity profile substantially exceeds the UL 1971 Standard light intensity profile, then the back-up battery power source is likely to become prematurely depleted due to the power drain from the light emitting device. Consequently, the life cycle of the light emitting device may be adversely affected.

An effective method for quantifying the intensity profile of the light emitting device is by determining the percentage of maximum intensity at points along the vertical and horizontal arcs. For example, the UL 1971 Standard requires 100% of the maximum intensity at 0° along the horizontal arc and 25% of the maximum intensity at 90° along the horizontal arc. Along the vertical arc, the UL 1971 Standard requires 100% of the maximum intensity at 0° and 12% of the maximum intensity at 90°. The light emitting device according to the present invention closely tracks the UL 1971 Standard at all points along the vertical and horizontal arcs.

The intensity data set forth below consist of data points for the graphs of FIGS. 5–8. These data points were generated by a light emitting device according to the present invention and are intended to be exemplary of the intensity profile generated by the light emitting device of the present invention. The percentage of maximum intensity at each angle can be calculated from the intensity data. For example, at 0° along the horizontal arc, the light emitting device of the present invention yields about 93% of its maximum intensity and at 90° along the horizontal arc the light emitting device according to the present invention yields about 35% of its maximum intensity.

High Power Intensity Data

| Deg. Horz | UL's min. (candela) | Present Invention (candela) |
|---|---|---|
| 90 | 27.5 | 49.5 |
| 85 | 27.5 | 57.3 |
| 80 | 33 | 58.6 |
| 75 | 33 | 58.1 |
| 70 | 38.5 | 61.5 |
| 65 | 38.5 | 61.4 |
| 60 | 44 | 62.6 |
| 55 | 49.5 | 63.7 |
| 50 | 60.5 | 74.1 |
| 45 | 82.5 | 96 |
| 40 | 82.5 | 99.7 |
| 35 | 82.5 | 98.4 |
| 30 | 82.5 | 110.9 |
| 25 | 99 | 125.7 |
| 20 | 99 | 139.2 |
| 15 | 99 | 150.9 |
| 10 | 99 | 151 |
| 5 | 99 | 150.7 |
| 0 | 110 | 150.7 |
| 5 | 99 | 155.5 |
| 10 | 99 | 152.5 |
| 15 | 99 | 156.6 |
| 20 | 99 | 161.6 |
| 25 | 99 | 142.4 |
| 30 | 82.5 | 122.1 |
| 35 | 82.5 | 109 |
| 40 | 82.5 | 97.2 |
| 45 | 82.5 | 88.3 |
| 50 | 60.5 | 95.6 |
| 55 | 49.5 | 75.2 |
| 60 | 44 | 66.3 |
| 65 | 38.5 | 62.4 |
| 70 | 38.5 | 62.4 |
| 75 | 33 | 62.1 |
| 80 | 33 | 60.9 |
| 85 | 27.5 | 58.8 |
| 90 | 27.5 | 55.9 |

| Deg. Vert | UL's min. (candela) | Present Invention (candela) |
|---|---|---|
| 0 | 110 | 149.6 |
| 5 | 99 | 156.7 |
| 10 | 99 | 158.6 |
| 15 | 99 | 155.1 |
| 20 | 99 | 145.1 |
| 25 | 99 | 141.6 |
| 30 | 99 | 141.1 |
| 35 | 71.5 | 135.4 |
| 40 | 50.6 | 139.3 |
| 45 | 37.4 | 135.9 |
| 50 | 29.7 | 136.1 |
| 55 | 24.2 | 122.8 |
| 60 | 19.8 | 119.9 |
| 65 | 18.6 | 119 |
| 70 | 16.5 | 106.7 |
| 75 | 14.3 | 88.5 |
| 80 | 13.2 | 59.7 |
| 85 | 13.2 | 42 |
| 90 | 13.2 | 25.7 |

Low Power Intensity Data

| Deg. Horz | UL's min. (candela) | Present Invention (candela) |
|---|---|---|
| 90 | 3.75 | 7.40 |
| 85 | 3.75 | 7.70 |
| 80 | 4.50 | 7.90 |
| 75 | 4.50 | 7.80 |
| 70 | 5.25 | 7.80 |
| 65 | 5.25 | 7.80 |
| 60 | 6.00 | 8.20 |
| 55 | 6.75 | 8.00 |
| 50 | 8.75 | 9.00 |
| 45 | 11.25 | 14.30 |
| 40 | 11.25 | 16.50 |
| 35 | 11.25 | 15.80 |
| 30 | 11.25 | 14.80 |
| 25 | 13.50 | 17.70 |
| 20 | 13.50 | 22.50 |
| 15 | 13.50 | 23.20 |
| 10 | 13.50 | 21.30 |
| 5 | 13.50 | 20.20 |
| 0 | 15.00 | 21.20 |
| 5 | 13.50 | 20.20 |
| 10 | 13.50 | 21.90 |
| 15 | 13.50 | 22.00 |
| 20 | 13.50 | 22.00 |
| 25 | 13.50 | 18.30 |
| 30 | 11.25 | 16.30 |
| 35 | 11.25 | 16.90 |
| 40 | 11.25 | 17.90 |
| 45 | 11.25 | 15.30 |
| 50 | 8.75 | 9.90 |
| 55 | 6.75 | 9.00 |
| 60 | 6.00 | 8.90 |
| 65 | 5.25 | 8.90 |
| 70 | 5.25 | 8.70 |
| 75 | 4.50 | 8.40 |
| 80 | 4.50 | 8.20 |
| 85 | 3.75 | 7.80 |
| 90 | 3.75 | 6.60 |

| Deg. Vert | UL's min. (candela) | Present Invention (candela) |
|---|---|---|
| 0 | 15.00 | 20.00 |
| 5 | 13.50 | 20.10 |
| 10 | 13.50 | 20.30 |
| 15 | 13.50 | 20.30 |
| 20 | 13.50 | 20.10 |
| 25 | 13.50 | 18.70 |
| 30 | 13.50 | 17.80 |
| 35 | 9.75 | 17.20 |
| 40 | 6.90 | 17.50 |
| 45 | 5.10 | 17.10 |
| 50 | 4.10 | 16.40 |
| 55 | 3.30 | 15.80 |

-continued

| | | |
|---|---|---|
| 60 | 2.70 | 14.60 |
| 65 | 2.40 | 13.80 |
| 70 | 2.25 | 13.60 |
| 75 | 1.95 | 13.50 |
| 80 | 1.80 | 7.90 |
| 85 | 1.80 | 5.10 |
| 90 | 1.80 | 3.35 |

It may be desirable to employ devices having various maximum intensity values for different applications. For example, the UL requires that the light emitting device yield a maximum intensity value of 110 candela (high power device) if the light emitting device is too be installed in a room where occupants are sleeping. If the light emitting device is to be installed in areas where the occupants are awake, the UL requires that the light emitting device yield a maximum intensity of only 15 candela (low power device).

In accordance with the present invention, the maximum intensity generated by the light emitting device can be varied in several ways. A simple way to vary the maximum intensity without substantially changing the intensity profile is to change the light source 50. However, any substantially increase in the width of the light sources may result in unfavorable alteration of the intensity profile. That is, the width of the light source 50 is substantially increased, the geometry of the reflector assembly 25, the lamp and/or the transparent cover 60 may need to be altered in order to avoid unfavorable alteration of the intensity profile. For example, a xenon flash tube about 42 mm long and about 3.6 mm wide having a nominal flash energy of about 4 joules was used to substantially match the UL requirements for a high power device. A xenon flash tube about 30 mm long and about 3.6 mm wide having a nominal flash energy of about 0.9 joules was used to substantially match the UL requirements for a low power device.

Figure 13:
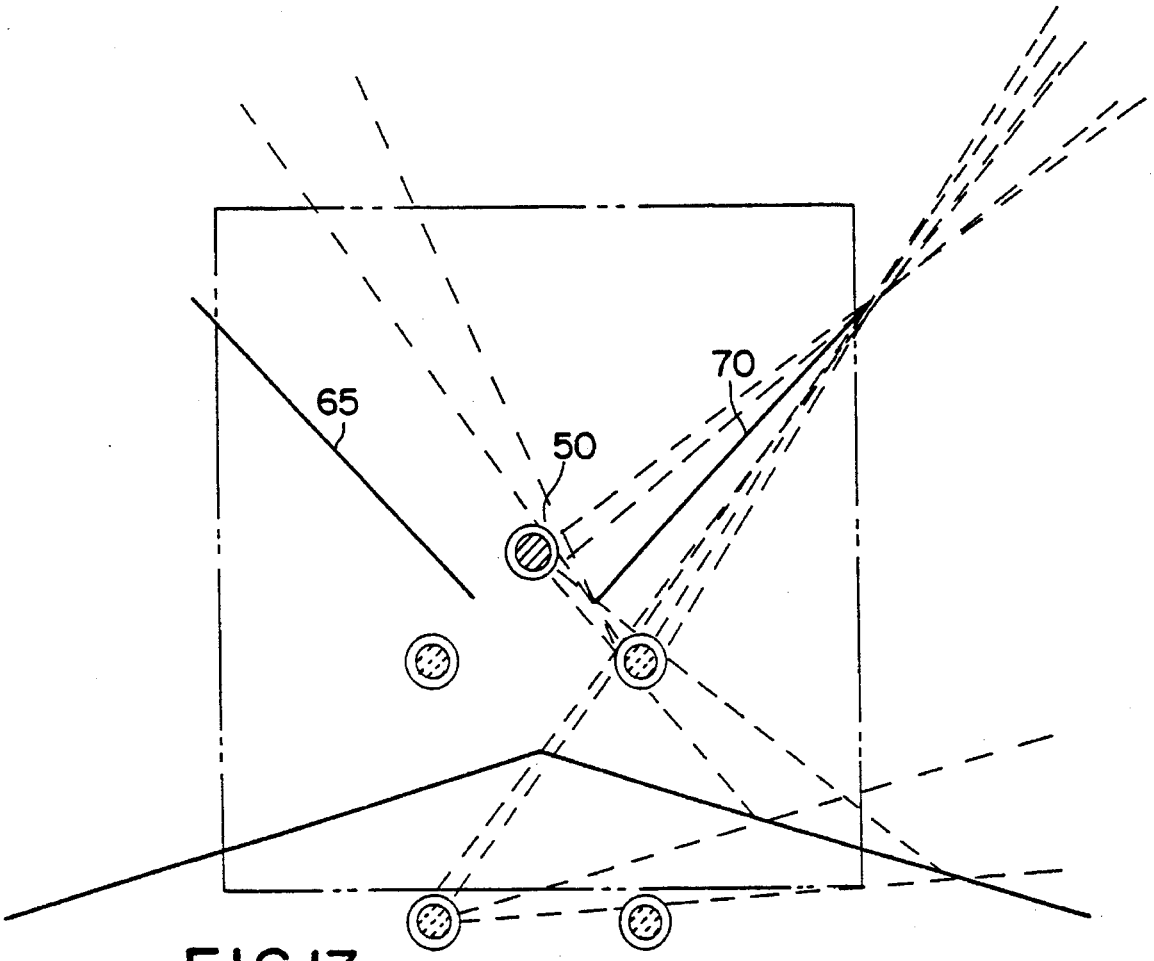
FIG. 13 is a ray diagram illustrating the path of light reflected in the light emitting device according to an embodiment of the invention.
Figure 14:
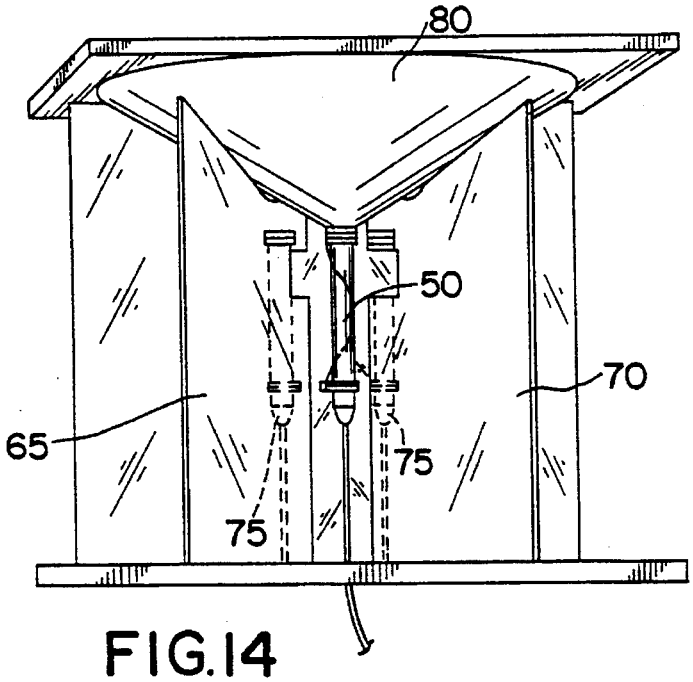
FIG. 14 is a perspective view of a light emitting device according to an embodiment of the invention.

The light emitting device according to this invention encompasses several variations of the previously described device. For example, instead of an ogive-shaped reflector surface, the reflector surface may be comprised of a series of plane reflectors. FIG. 13 represents a ray tracing diagram for a reflector assembly 25 including planer reflectors. FIG. 14 depicts a light emitting device having planer reflectors wherein the abutment 80 is conical.

Figure 15:
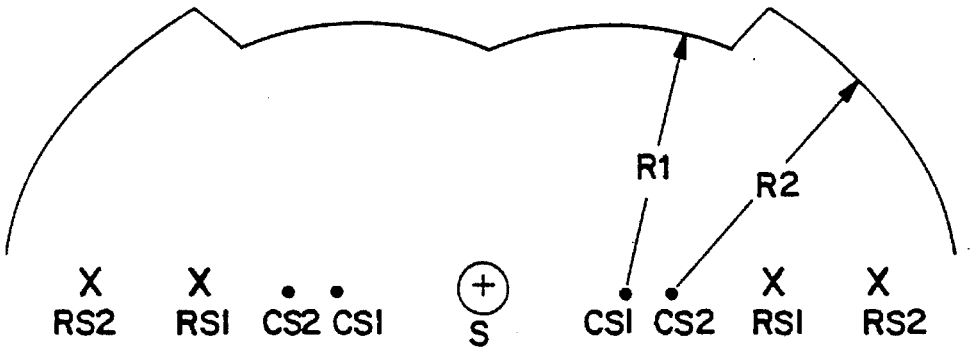
FIG. 15 is cross-section of a reflective surface and light source according to an embodiment of the invention.
Figure 16:
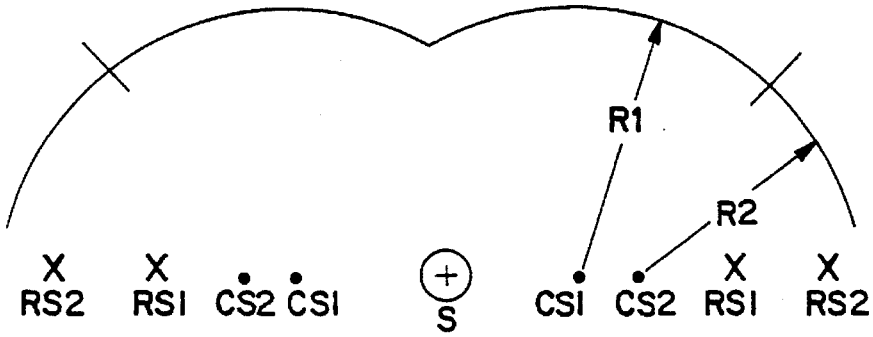
FIG. 16 is cross-section of a reflective surface and light source according to an embodiment of the invention.
Figure 17:
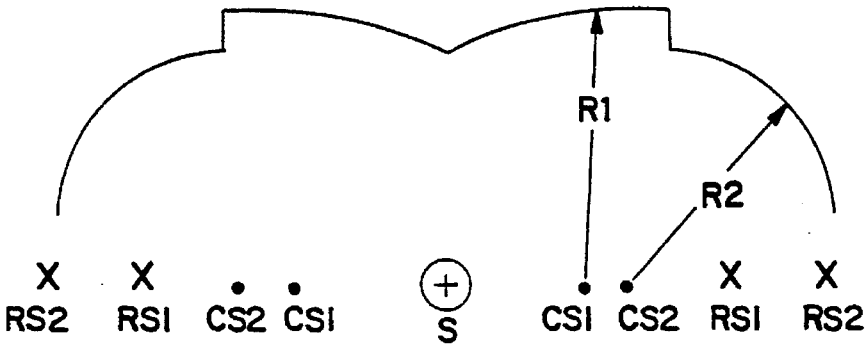
FIG. 17 is cross-section of a reflective surface and light source according to an embodiment of the invention.

In addition, each section of the reflective surface 27 may comprise a combination of the aforementioned surfaces. FIGS. 15–17 illustrate reflective surface 27*s* where each section includes two parts. R1 and R2 represent the radii of curvature of each part. CS1 and CS2 represent the centers of curvature of each part. RS1 and RS2 represent the location of the reflected sources generated by each part. S represents the source. In FIG. 15, R1 is less than R2. In FIG. 16, R1 is slightly greater than R2. In FIG. 17, R1 is distinctly greater than R2.

Figure 19:
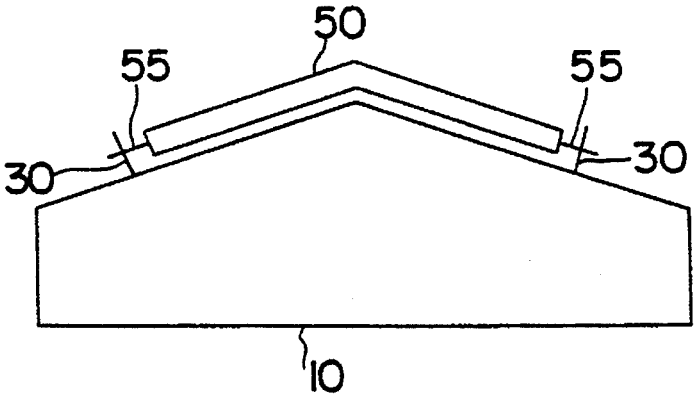
FIG. 19 is a side view of a light emitting device according to an embodiment of the invention.

The above described embodiments of the invention are primarily intended to be wall mounted as depicted in FIG. 1. However, an embodiment intended for ceiling mounting is shown in FIG. 19. This embodiment may be realized by placing a pair of devices according to the first embodiment back to back and removing the abutment 80 from the devices. The light source 50 may be either a continuous V-shaped flash tube or it may be a pair of substantially linear flash tubes.

While several variations of the invention have been described, it should be understood that the invention encompasses various modifications and alternative forms of the embodiments. It should also be understood that the specific embodiments are not intended to limit the invention, but are intended to cover all modifications, equivalents and alternatives falling within the scope of the claims.

We claim:

1. A light emitting device for generating a light beam and efficiently distributing its candela power through a 180° arc centered at the device, the device comprising in combination, a chassis for mounting to a surface; a light source and a reflector assembly for reflecting light radiated by the light source to form the light beam, the light source being disposed along the arc at a 90° point a transparent cover for mating with the chassis and enclosing the light source and the reflector, the reflector assembly having a reflective surface forming first and second reflections of the light source visible at the 90° point along the arc, and a standoff for providing a spatial relationship between the reflector assembly and the light source that distributes a sum of the reflections and the light source visible at any angle of the arc in a manner approximately proportional to a desired distribution of candela levels of the beam along the arc.

2. The light emitting device as set forth in claim 1 wherein the reflective surface of the reflector assembly includes two cylindrical sections aligned such that a longitudinal axis of one cylindrical section is parallel with a longitudinal axis of the other cylindrical section.

3. The light emitting device of claim 2 wherein a cross-section of the reflective surface is shaped like an ogive.

4. The light emitting device of claim 2 wherein the reflective surface of the reflector assembly includes a surface that intersects the two cylindrical sections at one end of the two sections.

5. The light emitting device of claim 4 wherein the surface intersecting the two cylindrical sections is a conical section.

6. The light emitting device as set forth in claim 4 wherein the surface intersecting the two cylindrical sections is a planar section.

7. The light emitting device as set forth in claim 1 wherein the desired distribution of candela levels along the arc is a distribution of the light beam in a horizontal plane as set forth in the Underwriters Laboratory Standard 1971.

8. The light emitting device of claim 1 wherein the chassis and reflector assembly are integral and formed by the same composition of matter.

9. The light emitting device as set forth in claim 8 wherein the reflective surface is a layer of metallic material formed on the reflector assembly by way of a metalizing process using the reflector assembly as a substrate.

10. The light emitting device as set forth in claim 2 wherein the surface upon which the chassis is mounted is a planar surface and each of the longitudinal axes of the two cylinder sections of the reflective surface form an acute angle with the planar surface.

11. A light emitting device as set forth in claim 1 wherein the first and second reflective sections include planar surfaces.

12. A light emitting device comprising:

a chassis including a base;

a reflector assembly provided within said chassis;

a reflective surface formed on said reflector assembly, said reflective surface having an ogive shaped cross section including first and second reflective sections and a third reflective section abutting an end of the first and second reflective sections;

a light source coupled with said chassis and positioned between the first and second reflective sections; and a transparent cover mated to the chassis enclosing said light source and said reflective surface, said reflective surface and said light source being inclined with respect to the plane of the base of said chassis.

13. A light emitting device as set forth in claim 12 wherein an angle of inclination of said reflective surface and said light source includes the range of 10° to 15°.

14. A light emitting device as set forth in claim 13 wherein an angle of inclination of said reflective surface and said light source is about 13°.

15. A light emitting device as set forth in claim 12 wherein said reflective surface is vacuumetalized onto said reflector assembly.

16. A light emitting device as set forth in claim 12 wherein the third reflective surface includes a plate positioned at an obtuse angle from a longitudinal axis of said channel.

17. A light emitting device as set forth in claim 12 wherein the third reflective surface includes a cone.

18. A light emitting device as set forth in claim 12 wherein the first and second reflective surfaces include cylinders.

19. A light emitting device as set forth in claim 17 wherein said light source is positioned between the centers of the first and second reflective sections.

20. A light emitting device as set forth in claim 18 wherein said light source is positioned such that a distance between said light source and the center of the first reflective section is less than a focal length of the first reflective section and a distance between said light source and the second reflective section is less than a focal length of the second reflective section.

21. A light emitting device as set forth in claim 12 wherein said light source includes a xenon flash tube.

22. A light emitting device for efficiently distributing candela power through a horizontal arc centered at said light emitting device and through a vertical arc, said light emitting device comprising:

a chassis for mounting to a surface;

a reflector assembly formed in said chassis;

a light source having first and second ends and having a longitudinal axis that intersects the first and second ends;

a reflective surface formed on said reflector assembly, said reflective surface including a reflective section abutting one of the first and second longitudinal ends of said light source, and said reflective surface being configured to shape the horizontal and vertical intensity profiles of reflected light to such that the maximum light intensity at any point along the horizontal and vertical arcs substantially matches the Underwriters Laboratory 1971 Standard vertical and horizontal intensity profiles;

attachment members coupling the light source to said reflector assembly; and a transparent cover mated to said chassis enclosing said light source and said reflective surface.

23. The light emitting device as set forth in claim 22 wherein said reflective surface includes two cylindrical sections aligned such that a longitudinal axis of one cylindrical section is parallel with a longitudinal axis of the other cylindrical section.

24. The light emitting device of claim 23 wherein a cross-section of the two cylindrical sections is shaped like an ogive.

25. The light emitting device of claim 23 wherein said reflective surface includes a surface that intersects the two cylindrical sections at one end of the two sections.

26. The light emitting device of claim 25 wherein the surface intersecting the two cylindrical sections is a conical section.

27. The light emitting device as set forth in claim 25 wherein the surface intersecting the two cylindrical sections is a planar section.

28. A light emitting device comprising:

a chassis including a base;

a light source coupled with said chassis, the light source having a longitudinal axis;

a reflector assembly provided within said chassis, said reflector assembly including a reflective surface formed on said reflector assembly, the reflective surface including first and second reflective sections disposed symmetrically with respect to the longitudinal axis of said light source and a third reflective section abutting an end of the first and second reflective surfaces and extending upward from the first and second reflective sections.

29. A light emitting device comprising:

a chassis including a base;

a reflector assembly provided within said chassis;

a reflective surface formed on said reflector assembly, said reflective surface including first and second reflective sections;

a light source coupled with said chassis, said light source being positioned between the first and second reflective sections, said reflective surface being configured to form one or more reflections of said light source, the one or more reflections being disposed parallel to and coplanar with said light source and with each other.

* * * * *